US008152400B2

(12) United States Patent
LaFlamme et al.

(10) Patent No.: US 8,152,400 B2
(45) Date of Patent: Apr. 10, 2012

(54) SURFACE CLEANER WITH REMOVABLE WAND

(75) Inventors: Roger J. LaFlamme, Enfield, CT (US); Jim F. Warner, Westfield, NJ (US)

(73) Assignee: Sealed Air Corporation (US), Elmwood Park, NJ (US)

( * ) Notice: Subject to any disclaimer, the term of this patent is extended or adjusted under 35 U.S.C. 154(b) by 1085 days.

(21) Appl. No.: 12/035,040

(22) Filed: Feb. 21, 2008

(65) Prior Publication Data

US 2008/0205972 A1 Aug. 28, 2008

Related U.S. Application Data

(60) Provisional application No. 60/891,331, filed on Feb. 23, 2007.

(51) Int. Cl.
*A46B 11/02* (2006.01)
*B43K 5/02* (2006.01)

(52) U.S. Cl. ..... 401/188 R; 401/187; 401/205

(58) Field of Classification Search ..... 401/185, 401/187, 188 R, 205–207, 270, 278; 222/372, 222/373, 383.1, 385
See application file for complete search history.

(56) References Cited

U.S. PATENT DOCUMENTS

| | | | |
|---|---|---|---|
| 886,984 | A | 5/1908 | Jopling |
| 1,217,054 | A | 2/1917 | Pearman |
| 1,941,745 | A | 1/1934 | Higley |
| 2,589,743 | A | 3/1952 | Snaith |
| 2,714,475 | A | 8/1955 | Roehrich |
| 2,855,127 | A | 10/1958 | Lerner et al. |
| 3,223,289 | A | 12/1965 | Bouet |
| 3,396,419 | A | 8/1968 | Richter et al. |
| 3,617,139 | A | 11/1971 | Ross |
| 3,949,137 | A | 4/1976 | Akrongold et al. |
| 3,981,106 | A | 9/1976 | Gallo |
| 4,004,854 | A | 1/1977 | Breer, II |
| 4,074,944 | A | 2/1978 | Xavier |
| 4,098,434 | A | 7/1978 | Uhlig |

(Continued)

FOREIGN PATENT DOCUMENTS

DE 4030851 4/1992

(Continued)

OTHER PUBLICATIONS

Plastic Bags for You—Pouch Category: Pouch (zipper & non zipper), Flat Pouch, Stand up Pouch, With and Without Valve, With and Without Window, Plain & Pre-printed, Paper Bags, etc.; www.plasticbagsforyou.com; © 2004 by PlasticBagsForYou.com; 6 pages.

(Continued)

*Primary Examiner* — Tuan Nguyen
(74) *Attorney, Agent, or Firm* — St. Onge Steward Johnston & Reens LLC

(57) ABSTRACT

A surface scrubbing device includes a pad base member that has at least one exit port with a connection structure provided on the pad base member. A surface engaging member is attached to the pad member. A storage chamber is provided within the scrubbing pad member with fluid stored therein. The storage chamber being positioned within the pad base member. A user manipulatable valve is provided in communication with the storage chamber so that depression of the button urges fluid the storage chamber through the exit port and to the surface engaging member. A wand is removably connected to the pad member via the connection means to extend the reach of the scrubbing device.

15 Claims, 3 Drawing Sheets

U.S. PATENT DOCUMENTS 4,124,316 A 11/1978 O'Rourke
4,127,515 A 11/1978 MacRae et al.
4,188,989 A 2/1980 Andersen
4,564,127 A 1/1986 Garabedian et al.
4,702,397 A 10/1987 Gortz
4,728,006 A 3/1988 Drobish et al.
4,753,006 A 6/1988 Howe
4,760,642 A 8/1988 Kwak
4,809,432 A 3/1989 Schauble
4,826,340 A * 5/1989 Rothweiler et al. ..... 401/205
4,886,388 A 12/1989 Gulker et al.
4,888,868 A 12/1989 Pritchard
4,889,441 A 12/1989 Tice
4,890,744 A 1/1990 Lane, Jr. et al.
4,993,594 A 2/1991 Becker et al.
5,014,427 A 5/1991 Byrne
5,016,351 A 5/1991 Drahus
5,074,765 A 12/1991 Pekar
5,114,255 A 5/1992 Villarreal
5,168,628 A 12/1992 Mock et al.
5,176,510 A 1/1993 Nilsson
5,207,355 A 5/1993 Thomsen
5,261,570 A 11/1993 Hippely et al.
5,265,772 A 11/1993 Bartasevich et al.
5,303,851 A 4/1994 Libit et al.
5,337,478 A 8/1994 Cohen et al.
5,353,961 A 10/1994 Debush
5,356,039 A 10/1994 Christine et al.
5,372,487 A 12/1994 Pekar
5,387,207 A 2/1995 Dyer et al.
5,388,728 A 2/1995 Gueret
5,441,345 A 8/1995 Garvey et al.
5,454,659 A * 10/1995 Vosbikian et al. ..... 401/207
5,482,980 A 1/1996 Pcolinsky
5,505,341 A 4/1996 Gueret
5,555,673 A 9/1996 Smith
5,564,190 A 10/1996 Fleetwood
5,640,737 A 6/1997 Boggs
5,700,245 A 12/1997 Sancoff et al.
5,701,674 A 12/1997 Mitchell
5,704,723 A 1/1998 Salisian
5,761,813 A 6/1998 Frick et al.
5,836,482 A 11/1998 Ophardt et al.
5,842,607 A 12/1998 Snider
5,855,066 A 1/1999 Manager
5,865,554 A 2/1999 Lin
5,934,296 A 8/1999 Clay
5,944,032 A 8/1999 Masterson
5,950,928 A 9/1999 Giang et al.
5,983,500 A 11/1999 da Silva
6,183,154 B1 2/2001 Coe
6,210,064 B1 4/2001 White et al.
6,251,098 B1 6/2001 Rake et al.
6,302,607 B1 10/2001 Burrowes et al.
6,394,316 B1 5/2002 Daansen
6,394,683 B1 5/2002 Pao
6,406,207 B1 6/2002 Wiegner et al.
6,419,118 B1 7/2002 Rees et al.
6,558,629 B1 5/2003 Davidson
6,623,201 B2 9/2003 Brumlik
6,629,799 B2 10/2003 Flores, Jr.
6,641,307 B2 11/2003 Matsuda et al.
6,715,952 B1 4/2004 Aiken et al.
6,754,958 B2 6/2004 Haws et al.
6,789,321 B2 9/2004 Simms
6,789,706 B2 9/2004 Abergel et al.
6,843,368 B1 1/2005 Frutin
6,868,987 B2 3/2005 Hedington et al.
6,883,563 B2 4/2005 Smith
6,886,254 B1 5/2005 Pennella
6,910,274 B1 6/2005 Pennella et al.
6,925,716 B2 8/2005 Bressler et al.
6,929,155 B1 8/2005 Sayers
6,964,097 B2 11/2005 Franzini et al.
6,996,908 B2 2/2006 Orloff et al.
7,043,841 B2 5/2006 Franzini et al.
7,121,754 B2 10/2006 Bressler et al.
7,137,203 B2 11/2006 Bressler et al.
7,137,531 B2 11/2006 Arghyris et al.
7,156,132 B2 1/2007 O'Dougherty et al.
7,159,742 B2 1/2007 Lee
7,682,097 B2 3/2010 Knopow et al.
2001/0025859 A1 10/2001 Dumont
2001/0025860 A1 10/2001 Auer
2002/0085873 A1 7/2002 Katsandres et al.
2003/0077106 A1 4/2003 Weihrauch
2003/0121936 A1 7/2003 De Laforcade
2004/0092864 A1 5/2004 Boehm, Jr. et al.
2004/0140326 A1 7/2004 Smart et al.
2004/0177510 A1 9/2004 Pennella
2004/0178284 A1 9/2004 Fahy et al.
2004/0206776 A1 10/2004 Awbrey et al.
2005/0138814 A1 6/2005 Pennella et al.
2005/0144785 A1 7/2005 Bressler et al.
2005/0199651 A1 9/2005 Laflamme et al.
2006/0072858 A1 4/2006 Kurosawa et al.
2006/0150386 A1 7/2006 Wanli et al.
2006/0254056 A1 11/2006 Coffin et al.
2006/0255068 A1 11/2006 Genosar
2006/0272154 A1 12/2006 Brevard
2007/0017098 A1 1/2007 Bressler et al.
2007/0084058 A1 4/2007 Szczepanowski et al.
2007/0214646 A1 9/2007 Bezdek

FOREIGN PATENT DOCUMENTS

DE 29719331 12/1997
DE 29818058 1/1999
FR 2628394 A1 9/1989
FR 2683759 11/1991
GB 2083142 A 3/1982
JP 6293348 10/1994
JP 10165668 6/1998
JP 2005199020 7/2005
WO 0176972 A1 10/2001
WO 0176974 A1 10/2001
WO 02071907 A1 9/2002
WO 2004096504 11/2004
WO 2005086852 A2 9/2005

OTHER PUBLICATIONS

3M Hong Kong; "Scotch-Brite(tm) Urethane Laminate 325HK 5 Pieces/Pack 72 Packs/Case"; http://products3.3m.com; © 3M 1995-2006; 1 page.

Stephenson & Lawyer, Inc; "Foam Fabrication for Engineered Applications"; www.steplaw.com; © 2005 Stephenson & Lawyer, Inc; 2 pages.

* cited by examiner

SURFACE CLEANER WITH REMOVABLE WAND

CROSS-REFERENCE TO RELATED APPLICATIONS

This application claims priority from prior U.S. Provisional Application Ser. No. 60/891,331 filed on Feb. 23, 2007.

BACKGROUND OF THE INVENTION

This invention relates generally to dispensing devices and packages. More specifically, the present invention relates to metering devices that can controllably dispense fluid media from a source of fluid media while simultaneously providing a construction for assisting in the delivery and application of the fluid media to a surface for treating that surface.

Various types of fluid material and media are employed for different purposes through commerce and industry. For example, there are various products in the personal care, home care, air care, transportation care, and food industries that require some type of dispensing of a fluid material from a source of such material. When this material is sold in commerce, it must be contained and stored in some type of container. When that product is used, it must be dispensed from its storage container to a location for use.

In the prior art, there are many different types of dispensers for delivering fluid material. For example, a flexible container body with a nozzle tip is commonly provided for such a purpose. An application of such use is for the dispensing of ketchup where the container body is squeezed by the user to urge the fluid material out from the nozzle tip and accurately to a desired location. The amount of fluid delivered is determined by the how much the user squeezed the container body. However, this yields erratic results where more or less fluid material is delivered on each successive squeeze of the container body. Also, the container must be held upright to avoid leakage because no valves are employed. Therefore, there is a need for a dispensing package that can deliver the media contained therein a controlled and metered fashion.

To meet this need, a flexible container holds a volume of fluid material to be delivered. A single one-way check valve is provided as an exit port from the flexible container. When the flexible body is squeezed, the material is urged out under pressure through the valve. In commonly owned Ser. No. 11/074,817, filed on Mar. 8, 2005, and U.S. Ser. No. 11/951,351, filed on Dec. 6, 2007 a dual valve construction is employed to provide for controlled metered dispensing of media from a package. However, these known devices require that the entire package be disposed of when the supply of media to be dispensed has been depleted.

There has also been a desire to not only dispense the fluid material but also to help apply them, such as to a surface. In the prior art, the squeezable container bodies have been equipped with some type of applicator head for this purposes. For example, in the home care cleaning industry, there are many types of surface cleaners that include a cleaning pad that contacts the surface to be cleaned. It is also common for the surface cleaning device to include an auxiliary supply of liquid cleaner to deliver directly to the surface to be cleaned. A supply of material is commonly mounted to the wand or handle of the device and a button or trigger is actuated to spray a desired amount of liquid cleaner to the surface in front of the cleaning pad on the device.

However, it is desirable to have the liquid cleaner be impregnated in the pad or be directed immediately under the pad rather than in front of the pad on the surface to be cleaned.

In the prior art, there is a particular need for an effective device that can dispense fluid materials in a metered and dosed fashion where the liquid can be controlled. It is also desirable that the device be convertible between an upright wand-controlled cleaning device for floors, and the like, and a hand-held device that does not employ a wand or handle for non-floor surfaces, such as walls and countertops.

In view of the foregoing, the surface scrubber devices with fluid dispensing capabilities of the prior art suffer from various disadvantages that make them difficult and awkward to use with unexpected results. Therefore, there is a need for a surface scrubber that is easy to operate. There is a further need for the option for a surface scrubber to be to be capable of delivering a metered dose of fluid upon each dispensing operation directly below the surface scrubber itself for better application of the fluid material. There is also a need for such a dispenser to be less wasteful than prior art dispensers. There is also a need for surface scrubber that can be operated with or without an extension wand for flexibility of operation and use.

SUMMARY OF THE INVENTION

The present invention preserves the advantages of prior art surface scrubbing and dispensing devices. In addition, it provides new advantages not found in currently available devices and overcomes many disadvantages of such currently available devices.

The invention is generally directed to a novel and unique surface cleaner and also includes an integral cleaning fluid dispenser for improving the cleaning effectiveness of the device. Many types of fluids may be dispensed using the present invention and cleaning fluid is one example and will be discussed in detail herein. This invention shall not be considered to be limited to the dispensing of cleaning fluid in a cleaning device environment.

The fluid dispensing device includes a container with an independently deformable bladder therein. A nozzle is in fluid communication with the bladder that contains a volume of liquid for dispensing. A flexible and/or compressible outer exoskeleton is preferably provided that maintains the bladder and the overall structure of the device in an upright or desired position an configuration. When the outer flexible and/or compressible exoskeleton is squeezed, the bladder container or retained therein is compressed thereby urging liquid from the storage bladder and out through the nozzle for dispensing. The nozzle may be of any configuration, such as a pin hole tip, slit, atomizer, or the like to suit the desired application at hand.

As seen in the attached drawing figures, the surface cleaning device of the present invention includes a cleaning pad base with a rigid, semi-rigid or soft base with a preferably textured foam cleaning surface on its underside. Within the body of the cleaning pad structure is a bladder or chamber that contains cleaning fluid. A metering chamber receives the fluid, via a one-way valve, to measure an amount of fluid. Upon pressing the bubble squeeze valve, or other valve configuration, a predetermined amount of cleaning fluid exits from the exit port or exit ports on the bottom of the pad to permit it to propagate throughout the foam for even cleaning. For cleaning a surface that is easily reachable, such as a countertop, the user can simply grasp the flanges of the cleaning pad and move it as desired for cleaning. When more cleaning fluid is needed to be delivered to the surface to be cleaned, the user simply presses against the valve to deliver the cleaning fluid, as described above.

Frequently, there are surfaces to be cleaned that are not easily reachable or are awkward to access over extended periods of time. For example, a floor or high up on a wall are difficult to reach thereby necessitating a extension wand or handle. As seen in the leftmost image on the attached drawings, the present invention includes a removable extension wand that attached directly to the cleaning pad base. Thus, the same cleaning pad can be used alone or in conjunction with the extension wand. Prior art devices are either for floor cleaning or for hand-held use.

The extension wand includes an elongated shaft that terminates on its lower end with a cup-like structure, which can be made of rubber or the like, that frictionally and pivotally engages with the circumferential flange located about the valve on the top of the cleaning pad base to provide a flexible coupling. The bottom cup, while engaged with the flange, can flex to permit pivoting during movement of the pad on the surface. The cup, and the wand attached thereto, can be easily removed so the pad can be used in hand-held fashion, if desired.

The wand also includes a structure for engaging the valve on the cleaning pad base to meter out cleaning fluid from the storage chamber. On the opposing end of the wand, a trigger is provided to preferably deliver a burst of air to depress the bubble valve on the top of the cleaning pad. A mechanical linkage may also be used to carry out this actuation of the valve. Also, the user may simply press down on the wand toward the valve to actuate it. Any type of actuation of the valve via the wand may be employed and still be within the scope of the present invention.

The bladder includes a pump and dispensing system that can deliver the media in a dosed and metered fashion. The container provides a outer exoskeleton that is preferably rigid but may also be semi-rigid to receive the internal dispensing bladder. When the internal bladder is depleted of media for dispensing, it may be simply removed and replaced with a new bladder while leaving the outer rigid exoskeleton container housing for re-use. This substantially saves on cost in that the outer housing need not be replaced entirely each time when the supply bladder is empty. The internal bladder and outer housing may be in any form or configuration to suit the dispensing application at hand.

It is also possible that the a pump and valve configuration may be employed to assist in moving liquid from the storage bladder and through the nozzle. For example, it is preferred that a flexible metering housing be disposed in fluid communication with the fluid storage region of the internal bladder with a first one-way valve disposed between the container and the flexible metering housing. One way flow from the interior fluid storage region of the container fills the predetermined volume of the metering chamber with fluid by vacuum action when the flexible metering housing is depressed and then released. A second valve is in fluid communication with the metering housing output port and permits one-way fluid flow from the metering chamber to the exterior outer region of the container to a desired position when the metering housing is depressed again. Each time the metering housing is depressed a substantially equal volume of fluid is dispensed from the container. Optionally, an additional applicator layer on the outside of container, such as foam, facilitates dispersion and delivery of the fluid.

The internal deformable bladder of the present invention may reside in the outer exoskeleton housing in many different ways with the pump dispensing mechanism exposed for manipulation by a user. For example, it may snap into the housing where the door of the housing secures the internal bladder in place during the use. The door may be easily opened to remove the bladder when it is empty and replace it with a new full bladder.

Therefore, it is an object of the present invention to provide a bottle that is capable of storing and dispensing liquid in a controlled fashion.

Another object of the present invention is to provide a bottle that can be squeezed to dispense the liquid while maintaining a consistent and aesthetically pleasing appearance at all times during use of the bottle.

It is also an object of the present invention to provide a fluid dispensing device that can deliver a substantially equal volume of fluid material from each dispensing operation.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

In general, the novel features of the present invention relate to a unique surface cleaning device 10 with a handheld portion 12 and an optional extension wand 14 attachment connected thereto to extend the reach of the cleaning device.

Figure 1:
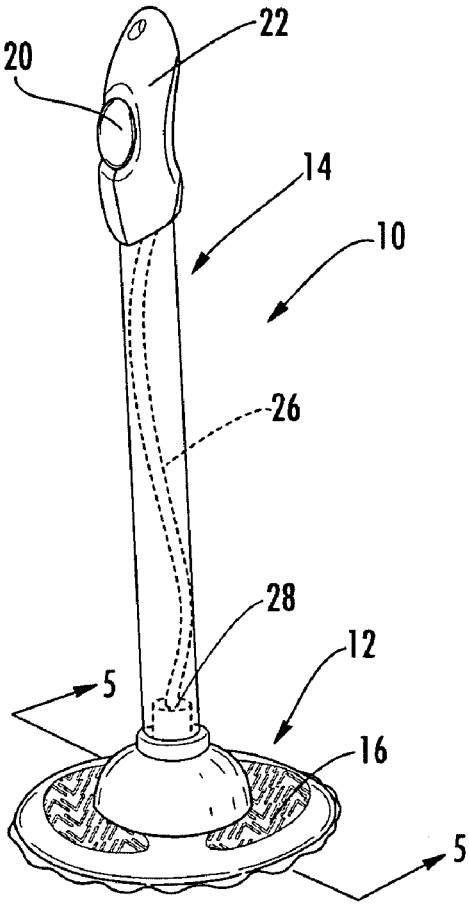
FIG. 1 is a perspective view of the surface cleaner with removable wand of the present invention.

Turning first to FIG. 1, the surface cleaning device 10 of the present invention generally include a handheld portion 12 and a wand 14 removably attached thereto. The handheld portion 12 of the cleaning device 10 includes a rigid, semi-rigid or soft housing member 16 with a preferably textured foam cleaning surface pad 18 with a textured surface 30 on its underside. The extension wand 14 is removably attached to the handheld portion 12 to extend the reach of the surface scrubber pad 18 when in operation. A button 20 is provided on the handle 22 of the wand 14 to actuate the pump mechanism 24 when the wand 14 is attached to the handheld portion 12 for extended reach operation. A controller cable 26 or other means is routed through the wand 14 to control an actuator 28 that is positioned proximal to the pump mechanism 24, as will be described in detail below.

The removable wand 14 is useful because, frequently, there are surfaces to be cleaned that are not easily reachable or are awkward to access over extended periods of time. For example, a floor or high up on a wall are difficult to reach while holding the handheld portion 12 direction in the hand thereby necessitating a extension wand 14 or handle. It should be understood that handheld portion of the cleaning device 10 can be used alone or in conjunction with the extension wand.

Figure 2:
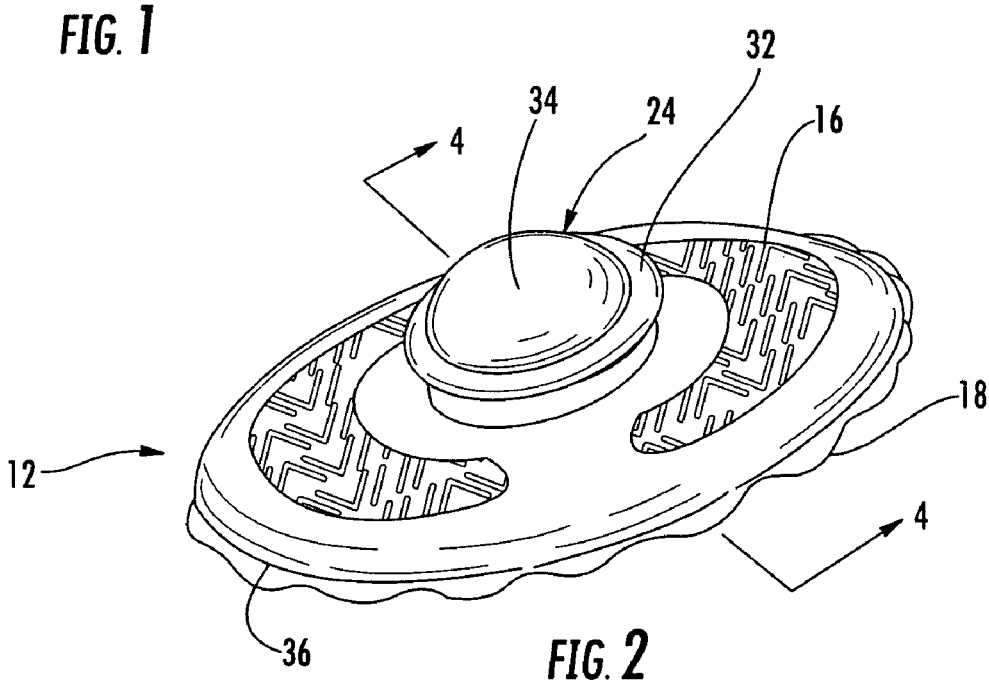
FIG. 2 is a perspective view of the surface cleaner of FIG. 1 with the wand removed.

FIG. 2 shows a perspective view of the handheld portion 12 of the cleaning device 10. A main housing 16 is provided with a connector member flanges 32 and a pump actuator button 34 on the top thereof. The bottom 36 of the main housing carries a scrubbing pad 18, which can be any type of known material for interfacing with a surface during treatment. These materials include cellulose foam, open cell foam, closed cell foam, urethane, reticulated foam and others.

Figure 3:
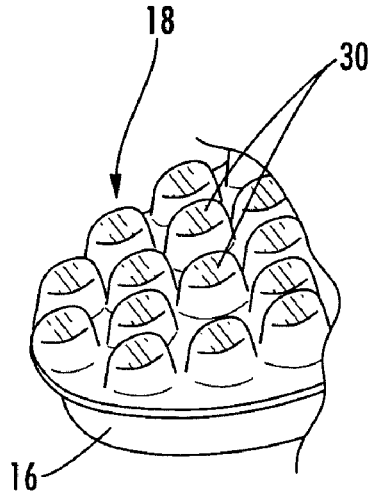
FIG. 3 is a close-up perspective view of the scrubbing surface of the surface cleaner.

FIG. 3 shows a close-up perspective view of a preferred embodiment of the scrubbing pad 18 attached to housing 16. In this embodiment, the pad 18 is shown as textured foam with an array of protrusions 30. However, it should be understood that this is only one of the many different types of material for the pad 18 that can be affixed to the bottom of the housing 16 of the handheld portion 12. The pad 18, shown in FIG. 3, can be either permanently attached to the bottom of the housing 16 or removably affixed thereto. For example, the scrubbing pad 18 may be removably affixed by clips, hook and loop fasteners and the like to permit easy replacement with a clean pad when the exiting materials becomes too dirty. Thus, the pad 18 can be easily discarded and replaced with clean scrubbing pad 18. It should also be understood that the scrubbing pad 18 may be any type of treatment pad that is not necessarily for scrubbing. For example, the pad 18 may be employed for polishing or applying a coating to a surface.

Figure 4:
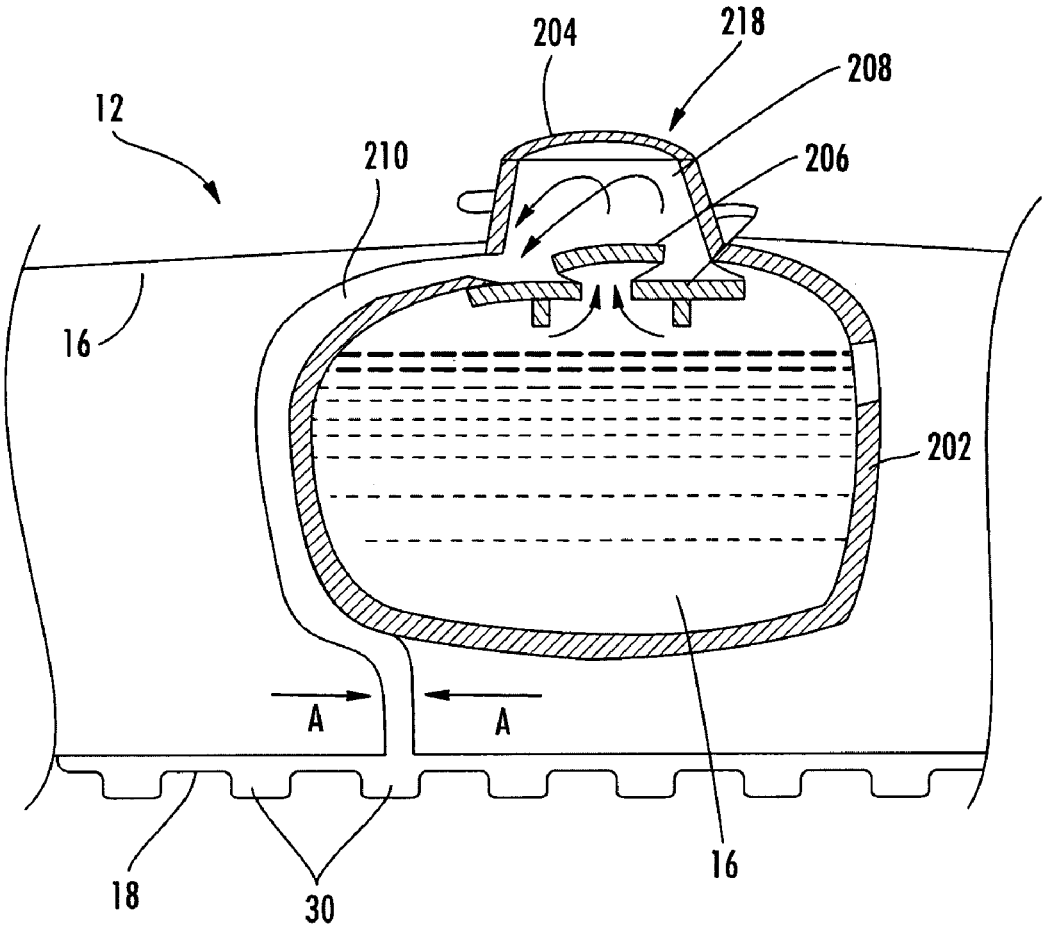
FIG. 4 is a cross-sectional view through the line 4-4 of FIG. 2 showing the pump mechanism for dispensing liquid.

Turning now to FIG. 4, within the handheld portion 12 is a bladder or chamber 202 that contains cleaning fluid 16. A metering chamber 208 receives the fluid, via a one-way valve, to measure an amount of fluid 16. Upon pressing the dome 204, a predetermined amount of cleaning fluid 16 exits from the exit port or exit ports 210 on the bottom of the pad 18 to permit it to propagate throughout the pad 18 for even cleaning. For cleaning a surface that is easily reachable, such as a countertop, the user can simply grasp the flanges of the handheld portion 12 and move it as desired for cleaning. When more cleaning fluid is needed to be delivered to the surface to be cleaned, the user simply presses against the dome 204 to deliver the cleaning fluid, as described above.

Still referring to FIG. 4, preferably, additional details of the metering dispensing pump are provided. Any type of pump mechanism can be used in the cleaning device of the present invention, however, a metering pump is preferred. A metering dispensing pump 218 for dispensing the liquid 16 in the present invention assists in delivering liquid to the pad for improving effectiveness thereof. Within the housing of the handheld portion 12, bladder 202 contains liquid 16. When released, a flexible dome 204 pulls liquid 16 upwardly through first valve 206 to fill metering chamber 208. When the dome 204 is depressed, the first valve closes and liquid 16 is urged out through exit port 210 down preferably to the surface of the pad 18. The exit port 210 acts as a second valve and, when liquid is not being pumped, the distance A is substantially reduced so that opposing sides of the exit port seal the dispenser to prevent accident dispensing. When dispensing is desired, the dome 204 is pressed and liquid 16 is urged out through the exit port 210 to expand it temporarily to permit outflow of liquid 16, as desired. More than one exit port 210 may be used to distribute liquid for dispensing and application via more than one location on the pad 18 for more even distribution thereof.

When the liquid in the bladder is depleted, it may be refilled in many different ways. For example, as seen in FIG. 4, a port may be opened for receiving new liquid for dispensing. Alternatively, the entire bladder, with or without the pump mechanism 218 may be replaced with a new one that is full of liquid 16.

Figure 5:
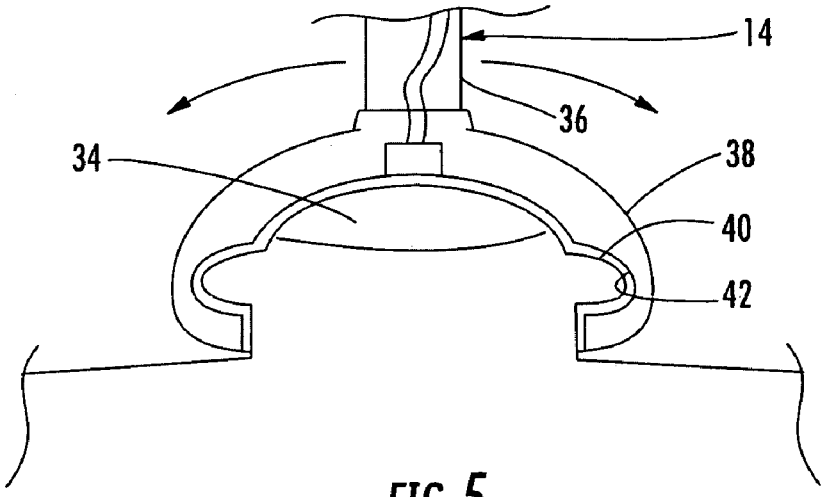
FIG. 5 is a cross-section view through the line 5-5 of FIG. 1 showing the interconnection of the wand extension member to the surface scrubber base.

Referring to FIG. 5, the extension wand 14 includes an elongated shaft 36 that terminates on its lower end with a flexible cup-like structure 38, which can be made of rubber or the like, that frictionally and pivotally engages with the circumferential flange 40 located about the dome 34 on the top of the handheld portion 12 to provide a flexible coupling. Since the cup 40 is flexible is can be easily stretched over the flange 40 to be removably secured thereto. For removable, the cup 40 be stretched slightly again to remove the flange from seat 42 on the inside of the cup 40.

The cup 38, while engaged with the flange 40, can flex to permit pivoting during movement of the pad 18 on a surface during use. The cup 38, and the wand 14 attached thereto, can be easily removed so the handheld portion 12 can be used directly and alone, if desired. The flexible engagement of cup 38 with the flange 40 of the handheld portion 12 is just one of many different types of coupling that can be used and still be within the scope of the present invention.

Referring to FIGS. 1 and 5, the wand 14 also includes a structure for engaging the dome 24 on the handheld portion 12 to meter out cleaning fluid 16 from the storage chamber 202. On the opposing end of the wand 14, the trigger 20 is provided to preferably deliver a burst of air from an air source to depress the dome 34 on the top of the handheld portion 12 of the cleaning device 10. A mechanical linkage may also be used to carry out this actuation of the dome 34 of the pump 24. Alternatively, the user may simply press down on the wand 14 toward the dome 34 to actuate it. Any type of actuation of the dome to effectuate pumping via the wand 14 may be employed and still be within the scope of the present invention.

Figure 6:
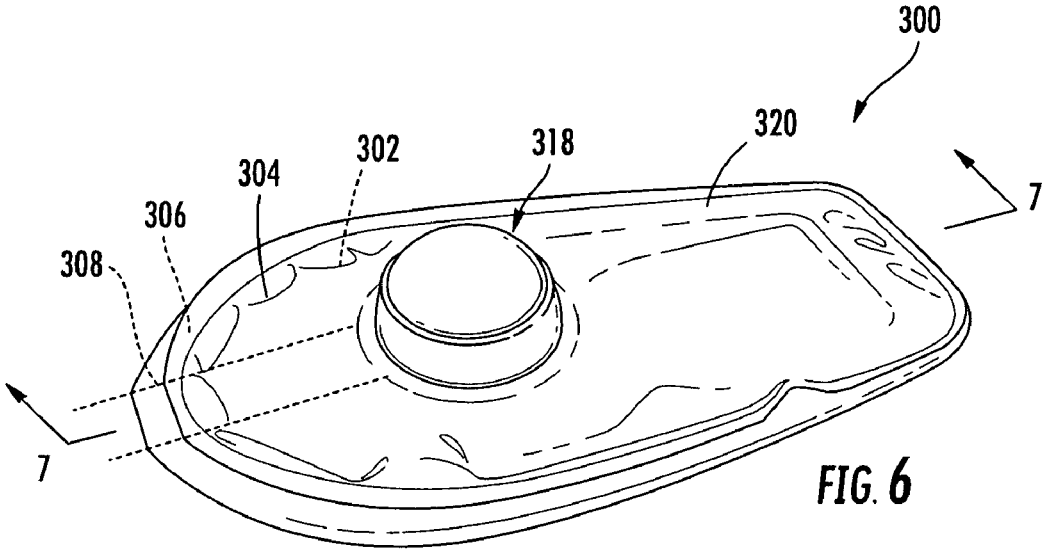
FIG. 6 is a front perspective view of another embodiment of the bladder and pump construction in accordance with the present invention.
Figure 7:
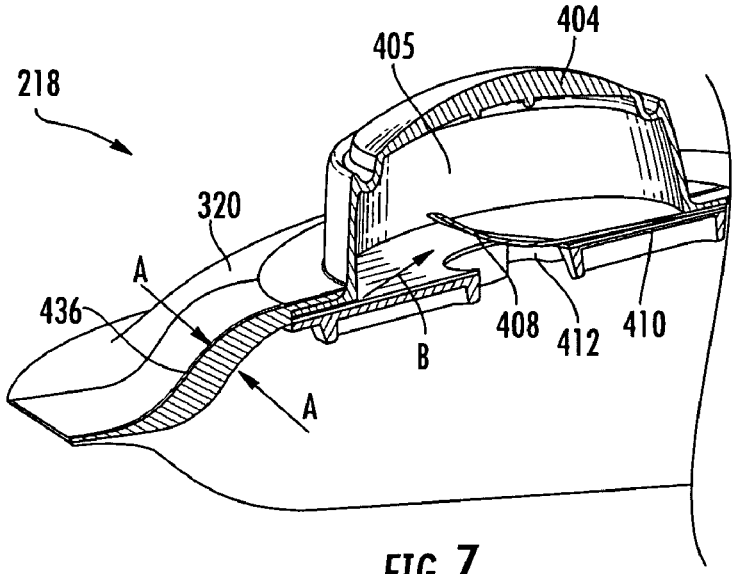
FIG. 7 is a cross-sectional view through the line 6-6 of FIG. 5.
Figure 8:
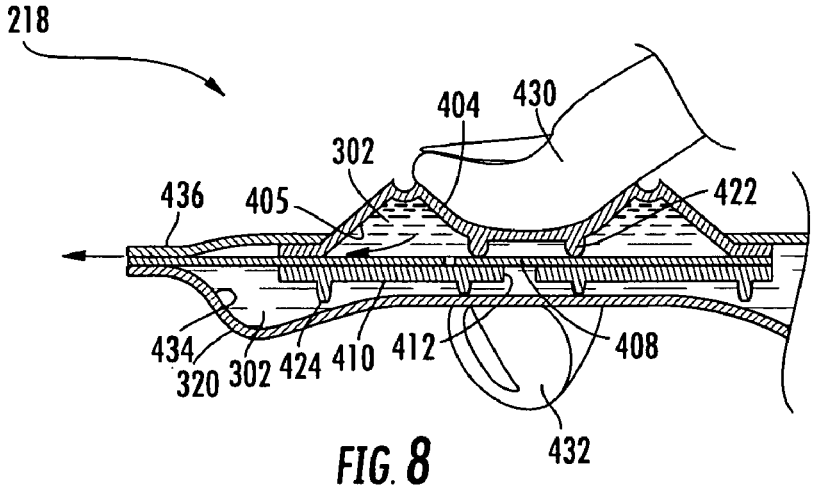
FIG. 8 is a cross-sectional view through the line 6-6 of FIG. 5 showing the pump and bladder in the process of dispensing fluid.

Another embodiment of the metering dispensing pump is shown in FIGS. 6-8. In FIG. 6, a perspective view of a metering dispenser 300 that employs the improved valving in accordance with the present invention. An outer storage bladder 320 is provided that may be formed of two sheets of material 304, 306 secured together, such as by welding, or a tube of material. A metering pump, generally referred to as 326, pulls liquid 302 from the bladder 320, meters it, and then dispenses it via an exit port 308.

Referring to FIGS. 6 and 8, the dispending of liquid 302 is shown. When it is desired to actually dispense the liquid product 302, the user's thumb 430 can depress the flexible dome 404 and the user's index finger 432 can invert the base plate 410 from convex to concave, by application of force against the stand-off legs 424, such that flexible dome 404, with the assistance of the stand-off legs 422 under the flexible dome, securely seals and provides a positive lock of the flapper valve 408 over and about the aperture 412 thereby closing the liquid flow passage back into the reservoir 434 of the storage container 320.

It is also possible that the base plate 410 is concave and then is inverted to a convex configuration. Other fingers of the user may be used to carry out this operation. Thus, the only path for the liquid 302 contained within the cavity 405 of dome 404 is to exit through the one-way outlet valve 436 for intended dispensing of the product, as indicated by the arrows in FIG. 14.

When applied to the cleaning device of the present invention, the surface, such as a floor, onto which the cleaning device is located can replace the functionality of the user's index finger 432 in FIG. 8 to ensure that flapper valve 408 remains closed when the liquid is dispensed. Further, the exit port 436 is routed into and optionally through the pad to deliver liquid to a desired location for use on a surface. As above, multiple output ports 436 can be used to distribute liquid 16 to multiple locations.

It should be understood that the stand-off legs 422 on the bottom of the flexible dome housing 404 and the stand-off legs 424 on the bottom of the base plate 410 can be modified in size, length and configuration to adjust the amount of squeezing necessary by the user's fingers 430, 432 to effectuate sealing of the flapper valve 408. For example, preferably four stand-off legs 422 are provided on the bottom of the flexible dome housing 404 in a 2×2 array and can be 1/32 of an inch in length. It is also possible that these stand-off legs 422 can be a single downwardly depending wall, such as in the shape of a circle or square. Such an array is configured to downwardly press against the one-way flapper valve 408 outside of the diameter of the aperture 412 through the base plate 410 to provide a good seal of the flapper valve 408 to the base plate 410.

FIG. 7 illustrates further structure to prevent unwanted dispensing of liquid. In addition to the improved valving, as above, automatic shut-off of the exit port passageway 436, when pressure is exerted on the exterior of the storage container 320, serves to prevent leakage. In FIG. 7, when pressured is applied to the outside of the storage container or pouch 320, as indicated by arrows referenced A, the exit port passageway 436 tends to collapse, flatten and squeeze closed. As a result, any material residing in the passageway is urged back into the cavity 405 of the flexible dome housing 404, as indicated by arrow referenced B. As a result, unwanted leakage is prevented when accidental or unintentional pressure is placed on the storage container 320. Such a leak prevention system can be easily incorporated into the cleaning device environment of the present invention.

In view of the foregoing, a new and unique surface cleaning device, with an integrated cleaning fluid dispenser, is provided. The new device can be operated in handheld fashion where the handheld portion is directly manipulated by the user. Also, the device may be operable with an extension wand to extend the reach thereof while still maintaining control of the device and being able to actuate the pump mechanism for delivery of liquid to the pad. Such flexibility enables surfaces to be comfortably treated by the user.

It would be appreciated by those skilled in the art that various changes and modifications can be made to the illustrated embodiments without departing from the spirit of the present invention. All such modifications and changes are intended to be covered by the appended claims.

What is claimed is:

1. A fluid delivery device, comprising:
a housing;
a surface engaging member attached to the housing;
a deformable bladder in the housing with a fluid stored therein;
a flexible metering pump accessible on an exterior of the housing, the flexible metering pump in fluid communication with the deformable bladder;
the flexible metering pump being configured such that actuation of the flexible metering pump urges a metered dose of the fluid from the deformable bladder through an exit port and onto the surface engaging member; and
a wand having a proximal end and a distal end removably attached to the housing at the proximal end via a connection member.

2. The fluid delivery device of claim 1, further comprising: means attached to the wand for actuating the flexible metering pump.

3. The fluid delivery device of claim 1, wherein the connection member is a circumferential flange disposed about the pump.

4. The fluid delivery device of claim 1, wherein the wand is pivotally attached to the connection member.

5. The fluid delivery device of claim 1, further comprising:
a button on the distal end of the wand, the button configured to deliver a blast of air via a duct to actuate the flexible metering pump.

6. The fluid delivery device of claim 5, wherein the duct is at least partially the wand.

7. The fluid delivery device of claim 1, further comprising:
a button on the distal end of the wand for mechanically actuating the flexible metering pump.

8. The fluid delivery device of claim 1, wherein the surface engaging member is at least partially composed of at least one of cellulose foam, open cell foam, closed cell foam, urethane, and reticulated foam.

9. The fluid delivery device of claim 1, wherein the flexible metering pump further comprises:
an inner cavity in the flexible metering pump;
a base plate attached to the flexible metering pump, the base plate having a top, a bottom, and a liquid flow aperture, the liquid flow aperture being in fluid communication with the deformable bladder;
a sheet of material attached to the top of the base plate, the sheet of material having a flap formed therein, the flap being located over the liquid flow aperture and having a first position and a second position;
wherein when the flap is in the first position the fluid from the deformable bladder is able to flow into the inner cavity of the flexible metering pump; and
wherein when the flap is in the second position the fluid is prevented from entering the inner cavity of the flexible metering pump.

10. A fluid delivery device, comprising:
a housing;
a surface engaging member attached to the housing;
a deformable bladder in the housing with fluid stored therein;
a flexible metering pump accessible on an exterior of the housing, the flexible metering pump in fluid communication with the deformable bladder;
the flexible metering pump being configured such that actuation of the flexible metering pump urges a metered dose of the fluid from the deformable bladder through an exit port and onto the surface engaging member;
a circumferential flange on the housing disposed about the flexible metering pump;
a wand having a proximal end and a distal end, the wand further having a flexible cup at its proximal end; and
wherein the flexible cup is capable of being stretched over the circumferential flange allowing the wand to be removably attached to the housing at the proximal end.

11. The fluid delivery device of claim 10, further comprising:
a button on the distal end of the wand, the button configured to deliver a blast of air via a duct to actuate the flexible metering pump.

12. The fluid delivery device of claim 11, wherein the duct is at least partially the wand.

13. The fluid delivery device of claim 10, further comprising:
a button on the distal end of the wand for mechanically actuating the flexible metering pump.

14. The fluid delivery device of claim 10, wherein the surface engaging member is at least partially composed of at least one of cellulose foam, open cell foam, closed cell foam, urethane, and reticulated foam.

15. The fluid delivery device of claim 10, wherein the flexible metering pump further comprises:

an inner cavity in the flexible metering pump;

a base plate attached to the flexible metering pump, the base plate having a top, a bottom, and a liquid flow aperture, the liquid flow aperture being in fluid communication with the deformable bladder;

a sheet of material attached to the top of the base plate, the sheet of material having a flap formed therein, the flap being located over the liquid flow aperture and having a first position and a second position, wherein when the flap is in the first position the fluid from the deformable bladder is able to flow into the inner cavity of the flexible metering pump; and wherein when the flap is in the second position the fluid is prevented from entering the inner cavity of the flexible metering pump.

* * * * *